US006219976B1

(12) United States Patent
Bond

(10) Patent No.: US 6,219,976 B1
(45) **Date of Patent: *Apr. 24, 2001**

(54) MULTI-PURPOSE, POSITIONING-FASTENING STRAP

(76) Inventor: William R. Bond, 4710 Asdee La., Woodbridge, VA (US) 22192

( * ) Notice: Subject to any disclaimer, the term of this patent is extended or adjusted under 35 U.S.C. 154(b) by 0 days.

This patent is subject to a terminal disclaimer.

(21) Appl. No.: 09/392,744

(22) Filed: Sep. 9, 1999

Related U.S. Application Data

(63) Continuation of application No. 08/448,687, filed on May 24, 1995, now Pat. No. 5,996,290.

(51) Int. Cl.[7] ..... E04H 12/20

(52) U.S. Cl. ..... 52/105; 52/650.2; 52/651.11; 52/652.1; 52/693; 33/679; 33/679.1; 33/669; 33/493; 33/494

(58) Field of Search ..... 52/105, 652.1, 52/693, 690, 717.03, 717.05, 650.2, 651.11; 33/668, 669, 613, 493, 494, 679, 679.1, 732, 755

(56) References Cited

U.S. PATENT DOCUMENTS

| | | | |
|---|---|---|---|
| 1,170,521 | | 2/1916 | Faison . |
| 2,387,986 | | 10/1945 | Evans . |
| 3,213,541 | * | 10/1965 | Raffman . |
| 3,230,628 | | 1/1966 | Hite . |
| 3,332,196 | | 7/1967 | Tuttle . |
| 3,390,494 | | 7/1968 | Chappie . |
| 3,412,470 | * | 11/1968 | Williams et al. . |
| 3,959,945 | | 6/1976 | Allen . |
| 4,040,232 | | 8/1977 | Snow et al. . |
| 4,301,596 | | 11/1981 | Sedlock . |
| 4,322,064 | | 3/1982 | Jarvis . |
| 4,669,235 | | 6/1987 | Reinen . |
| 4,679,325 | | 7/1987 | Sweatman . |
| 4,811,489 | | 3/1989 | Walker . |
| 4,845,858 | | 7/1989 | Thomas . |
| 4,927,696 | | 5/1990 | Berg . |
| 4,942,670 | | 7/1990 | Brandt . |
| 5,012,590 | | 5/1991 | Wagner et al. . |
| 5,056,234 | | 10/1991 | Han . |
| 5,161,345 | * | 11/1992 | Sobjack, Sr. . |
| 5,335,421 | * | 8/1994 | Jones, Jr. . |
| 5,452,523 | | 9/1995 | Jansen . |
| 5,461,795 | | 10/1995 | Kok . |
| 5,487,223 | | 1/1996 | Krane . |
| 5,501,019 | * | 3/1996 | Concari et al. . |
| 5,623,802 | | 4/1997 | Boushek et al. . |

FOREIGN PATENT DOCUMENTS

| | | |
|---|---|---|
| 1525432 | 11/1989 | (SU) . |

OTHER PUBLICATIONS

MTI Corporation "Dial/Vernier Caliper Guide Book".

* cited by examiner

*Primary Examiner*—Carl D. Friedman
*Assistant Examiner*—Yvonne M. Horton
(74) *Attorney, Agent, or Firm*—Palmer C. DeMeo

(57) ABSTRACT

A multi-purpose, positioning and fastening strap is disclosed for use in the construction of building structures. The strap is made from a flexible, durable, non-stretchable material and has a high breaking load. The strap is usable for various construction applications, such as, the fastening or holding down of tar or felt paper on a roof, the laying down of shingles on a roof, the erection of a trussing structure for a roof, the construction of a floor, etc. The durability and breaking load of the multi-purpose strap are critical physical characteristics which are necessary for its use in the aforementioned various construction applications.

19 Claims, 3 Drawing Sheets

MULTI-PURPOSE, POSITIONING-FASTENING STRAP

This application is a continuation of patent application Ser. No. 08/448,687 filed May 24, 1995 is now U.S. Pat. No. 5,996,290.

BACKGROUND OF THE INVENTION

1. Field of the Invention

The present invention relates generally to a multi-purpose, positioning and fastening strap with repetitive, spaced markings thereon and methods of its use in the construction of buildings. More particularly, this invention concerns a flexible, durable, substantially non-stretchable strap with coded, repetitive and spaced markings thereon. The strap, in one application thereof, will facilitate the use of a pneumatic hammer in the construction of buildings, in another application, will facilitate the alignment of shingles on a roof of a building, and, in other applications, will facilitate the alignment and fastening of repetitively spaced, structural members such as rafters, joists, and studs used in the construction of buildings. In all applications for the multi-purpose strap of this invention, the strap becomes an integral and permanent part of the building construction.

2. Description of the Related Art

Heretofore, layout or measuring tapes with repetitive, spaced markings thereon have been used in the construction of buildings but these tapes were generally not constructed from a material which would retain its integrity when subjected to the action of a pneumatic hammer and/or which would remain in tact when used to fasten or hold structural members in a spaced relationship in the construction of buildings. For example, the use of adhesive tapes in the construction of buildings is discussed in U.S. Pat. Nos. 4,845,858, 4,942,670 and 5,012, 590.

U.S. Pat. No. 4,669,235 discloses the use of a spacing and support member constructed from steel banding for spacing and attaching multiple cross-members of building structures; however, said spacing and support member does not have markings per se thereon but rather spaced protrusions for spacing of the cross-members and said spacing and support member does not appear to be flexible. U.S. Pat. No. 1,170,521 discloses the use of an alignment tape in the laying of roofing material, however, the material of the tape is disclosed at line 35, page 2, as being made out of cheap paper. U.S. Pat. No. 5,056,234 discloses the use of an elongated tape having inscribed thereon coded indicia for laying out courses for the installation of roofing tile of various sizes, however, the tape is of the reusable type with a releasable gripping means. U.S. Pat. No. 4,301,596 discloses a reusable measuring tape with numerical indicia thereon.

More recently, U.S. Pat. No. 5,161,345 discloses a flexible strap used for construction purposes wherein the strap has one set of marks thereon at predetermined, spaced points along the length thereof.

SUMMARY OF THE INVENTION

The present invention is directed towards a multi-purpose, positioning and fastening strap which is flexible, durable, and substantially non-stretchable. The strap has on one side thereof spaced periodic marks which may be color coded or comprised of different indicia. The marks are used in the alignment of shingles on the roof of a building or in the spacing and alignment of structural building members such as rafters, joists and studs. Another application for the strap, irrespective of the marks thereon, is its use in the fastening or holding down of tar or felt paper to a roof. In all applications of the multi-purpose strap of this invention, the strap becomes an integral or permanent part of the building structure. The spaced marks on the strap may, for example, be at 5", 16" and 24" spaced intervals or at any other intervals conventionally used in the construction of building structures; the markings at 5" may be of one color, at 16" of another color, and at 24" a third color. The strap itself is made from a flexible, durable, non-stretchable material, preferably, from a hard, durable plastic. The strap should have a high breaking load such that it will not break when subjected to nails driven therein by a pneumatic hammer or when subjected to the tensions brought about by being fastened to periodically spaced members such as rafters, joists or studs in a building structure. The strap may be ½", ¾", or 1" in width, other widths may also be used. The strap may be from several hundred feet to several thousand feet in length (or of any other convenient length) and may be dispensed from a closed or unenclosed dispenser. A strap suitable for this invention is "polystrap" which is commercially available and often used to bind stock materials, for example, plywood sheaths.

One application of the multi-purpose strap of this invention is holding down or fastening strips of tar or felt paper to the roof of a building. Generally, strips of tar or felt paper are laid down on the roof of a building in an overlapping manner and then nailed down to the base of the roof. The base of the roof is usually made from plywood of a predetermined thickness. The nailing is normally done manually by a roofer or carpenter using a conventional hammer and shingle nails. The nails are applied along the overlapping portions of the strips of tar or felt paper and along the end or side portions thereof This process is very time consuming. It would be advantageous to use a pneumatic hammer to drive the nails into the strips of tar or felt paper in order to fasten or secure them to the base of the roof since this would be a faster and less time-consuming process. However, when a pneumatic hammer is used to drive the nails into the strips of tar or felt paper in order to secure or fasten them to the roof, the driving force of the pneumatic hammer is so powerful that the nail-heads are driven completely through the strips of tar or felt paper thereby thwarting the securement or fastening of the strips of tar or felt paper to the roofing base. However, when the multi-purpose strap of this invention is used along the length of the overlapping portions of the strips of tar or felt paper, a pneumatic hammer can safely be used to drive the nails into the strips of tar or felt paper since the nail-heads are prevented from piercing through them due to the strength of the intervening strap. Another important advantage in laying down and fastening the tar or felt paper to the base in the overlap area with a multi-purpose strap of this invention is to insure that there is no wind blow-off or up-lift of the tar or felt paper before the shingles are laid down. Basically, the strap is laid down and stretched over the overlapping portions of adjacent strips of tar or felt paper and then nailed onto the base of the roof utilizing a pneumatic hammer. For this particular application the marks on the strap are not used.

Another application of the positioning-fastening strap of this invention is aligning and fastening the roofing trusses of a building. Normally, a first roofing truss is plumbed and then secured to one end of a roofing support frame and a second roofing truss is also plumbed and then secured to an opposite end of a roofing support frame. Additional trusses are subsequently spaced periodically from the first roofing truss utilizing a measuring tape or stick and a plurality of wooden cross members secured to the rafters of successively positioned trusses. Subsequent to this process, sheaths of plywood of a predetermined thickness are placed over the cross members and secured thereto, thereby forming the base of a roofing structure. The preceding is a time consuming process. In order to facilitate the construction of a roofing structure for a building, the positioning-fastening strap of this invention is utilized. A plurality of roofing trusses are to be mounted and secured to a support frame on top of a building structure. Instead of using a measuring tape or stick for alignment of the trusses and instead of using wooden cross members, a plurality of the positioning-fastening straps of this invention are stretched across and secured to the aforementioned plumbed opposing trusses. Then, each successive truss is spaced from the previous truss by means of positioning-fastening straps on the support frame and secured to the support frame. The trusses are further aligned along their rafters by the aforementioned plurality of stretched-across, positioning-fastening straps, the straps being secured to said rafters at the appropriate spaced marks thereon. A pneumatic hammer may be used for this securement process in order to reduce construction time.

Another application of the positioning-fastening strap of this invention is the laying down of shingles on the roofing structure of a building. Normally, shingles for a roofing structure are aligned with a measuring tape or stick having numerical indicia thereon or with a measuring tape having periodic spaced marks thereon. In either of the preceding situations, the measuring tape or stick has to be moved manually and repeatedly during the course of laying down the shingles. This process is tedious and time consuming. The laying down process of shingles on a roofing structure is facilitated by the use of the multi-purpose strap of this invention which strap is secured or fastened to the base of the roofing structure by means of, for example, a pneumatic hammer, and which strap becomes an integral part of the roofing structure.

A further application of the positioning-fastening strap of this invention is the construction of wooden floors for a building. Generally, a floor for a building consists of a base framework of parallely spaced, elongated, wooden members supported within a surrounding wooden frame. In the construction of this floor, it is usually necessary to maintain the parallely spaced alignment of the wooden members during the process of laying down and securing thereto floor sheaths, conventionally made from plywood. This is done by temporarily securing to the base framework a plurality of spaced, elongated, wooden members which are orthogonal to the wooden members of said framework. These orthogonal wooden members are sectionally removed to allow for the laying down and securement of each floor sheath to the base framework. The process of floor construction is facilitated by the use of the multi-purpose strap of this invention. Instead of using the plurality of orthogonal wooden members to maintain the spaced alignment of the elongated, wooden members of the base framework, a plurality of the multi-purpose straps of this invention are used. These straps are permanently secured or fastened to the parallely spaced, elongated, wooden members of the base framework and become a permanent, integral part of the floor. The straps may be secured or fastened to the base framework by using a pneumatic hammer. The preceding process of constructing a floor utilizing the multi-purpose straps of this invention results in a substantial saving of construction time for the carpenter.

It is an object of the present invention to provide a multi-purpose, positioning-fastening strap for use in the construction of buildings which use will facilitate construction procedures, reduce construction time and/or save in construction costs.

It is another object of this invention to use the multi-purpose strap of this invention in the fastening or holding down of tar or felt paper on the roof of a building.

It is a further object of this invention to use the multi-purpose strap of this invention in the erection of roofing trusses on the top of a building.

It is another object of this invention to use the multi-purpose strap of this invention in the laying down of shingles on the roof of a building.

It is a further object of this invention to use the multi-purpose strap of this invention in the construction of a floor for a building.

It is another object of this invention to use the multi-purpose strap of this invention to enable the increased use of a pneumatic hammer in the construction of buildings.

The foregoing objectives, features and advantages together with other objectives, features and advantages will become more apparent from the following more detailed description of the invention, as illustrated in the accompanying drawings in which like reference numerals refer to like parts throughout the different views. The drawings are schematic and not necessarily to scale, emphasis being placed instead upon illustrating principles of this invention.

DESCRIPTION OF THE PREFERRED EMBODIMENTS

Figure 1:
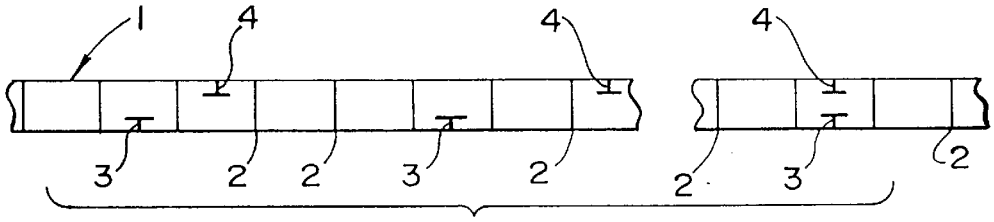
FIG. 1 is a schematic, fragmentized, surface view of the multi-purpose, positioning-fastening strap of this invention.

Referring now to FIG. 1, there is shown a multi-purpose, positioning-fastening strap 1 of this invention. As was previously mentioned, the strap is made from a flexible, durable, non-stretchable material such as a hard plastic having a high breaking load. The strap is substantially flat and may be of a few thousandths of an inch thick. Commercially available "polystrap" would be suitable for the multi-purpose strap of this invention. One form of the "polystrap" is made from polypropylene and has a breaking load of from 200–750 lbs. Another form of the "polystrap" is made from polyester and has a breaking load of from 500–1500 lbs. On one side of the strap 1, shown in FIG. 1, periodically spaced marks 2 are located along its length. Adjacent marks 2 may, for example, be spaced 5 inches apart to provide for the alignment of shingles on the roof of a building. The marks 2 may be in the form of a single line, as shown, or in the form of other desired indicia and may also be colored. Additionally, marks 3 are also shown located periodically along the length of the strap 1 on the same side as marks 2 but along one longitudinal edge of the strap. Each of the marks 3 is T-shaped with the stem of the T forming a centerline and with a cross-bar perpendicular to said stem. The cross-bar is located inwardly and parallel to the aforementioned longitudinal edge of the strap. Adjacent marks 3, for example, may be spaced 16 inches apart (from centerline to centerline) to provide for the periodic positions of floor joists or wall studs. The cross-bar may have a longitudinal width the same size as the thickness of a joist or stud, for example, one and a half inches. The cross-bar may be in the form of a line or a bar. Marks 3 may additionally be colored, a color different from that of marks 2 or may be of a different configuration, as desired. Marks 4 are located on the same side of the strap 1 and have the same configuration as marks 3 but are located on the opposite longitudinal edge of the strap as shown in FIG. 1. The cross-bars of each of the marks 3 and 4 are so positioned inwardly from their respective longitudinal edge that there is a finite space therebetween along the entire, longitudinal length of the strap. This is done in order to avoid overlapping coincidence of marks 3 and 4. The longitutinal width of each of the cross-bars of marks 4 may, for example, be 1 and ½ inches, the same size as the thickness of a rafter in a roofing truss. Marks 4 may also be colored but of a color different from those of marks 2 and 3. Marks 4 may be spaced, for example, 24 inches or 2 feet apart (from centerline to centerline) to provide for the periodic positions of trusses in the roofing structure of a building. As an alternative, marks 3 and 4 may be located on one side of the strap 1 and marks 2 located on the opposite or obverse side of the strap 1; this alternative would prevent any possible overlapping of any marks on the strap 1.

Figure 2B:
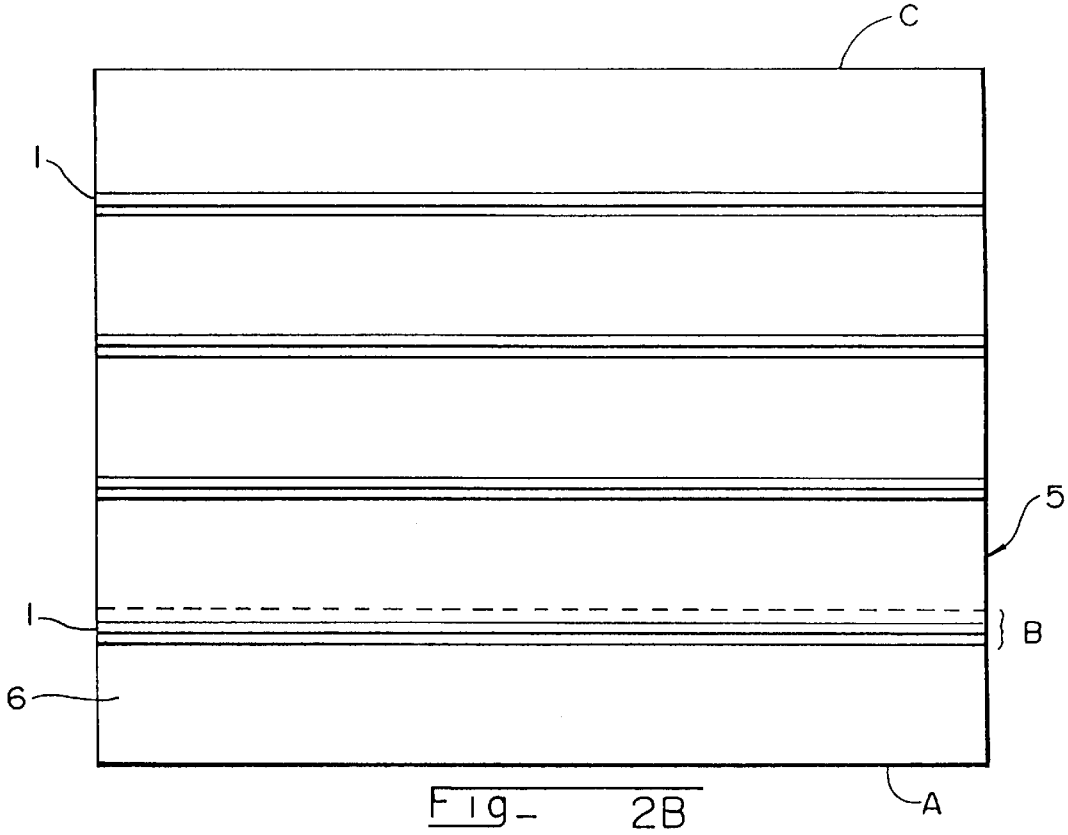
FIG. 2*b* is a completed, top plan view of a roofing structure utilizing the multi-purpose strap of this invention.
Figure 2A:
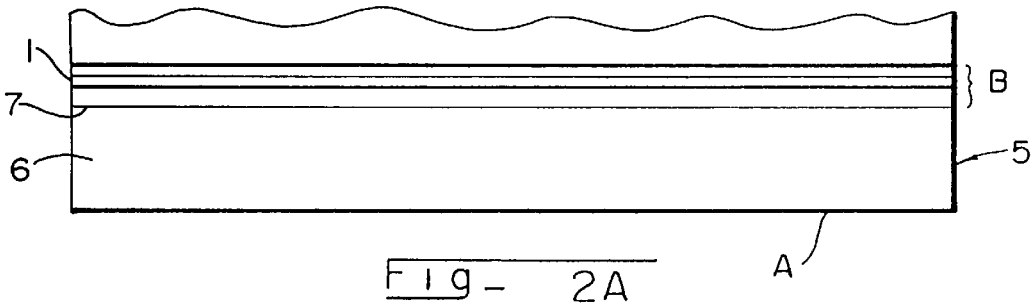
FIG. 2*a* is a partial, top plan view of a roofing structure utilizing the multi-purpose strap of this invention in the construction thereof.

Reference is now made to FIG. 2A wherein there is shown a base 5 of a roofing structure and a first strip of tar or felt paper 6 laid thereover. A conventional premarked line on the strip 6 is shown at 7 for positioning a succeeding laid down strip of tar or felt paper. This premarked line 7 together with the lagging edge of strip 6 defines an overlap portion B between successively laid down strips 6. The distance between the premarked line 7 and the lagging edge of strip 1 is conventionally 2 inches which defines the width of the overlap portion B. One application of the multi-purpose strap of this invention will now be described in the laying down and fastening of tar or felt paper with reference to this figure. A first strip 6 of tar or felt paper is laid down with the leading edge thereof aligned with the front side A of the base 5. This first strip 6 is held in place by a first roofer at one side of the roofing structure. Then, a second roofer tacks down, in the overlap portion B, one end of the strap 1 on an opposite side of the roofing structure. While the opposite end of the strap 1 is held in place over the overlap portion B, the second roofer secures or fastens the strap 1 to the base 5 at a plurality of locations between opposite ends of the strap 1 utilizing a pneumatic hammer to drive fastening means, e.g. , shingle nails, staples, etc., into said strap 1, through the strip 6 of tar or felt paper and into the base 5 of the roofing structure. A roofer then fastens or secures the strap 1 of this invention to the base 5 of the roofing structure in the overlap portion B of the first strip 6.

Reference is now made to FIG. 2B in conjunction with FIG. 2A. Once the first strip 6 is fastened or secured in the aforementioned manner, a second strip 6 of tar or felt paper is laid over the first strip 6 by aligning its leading longitudinal edge with the premarked line 7 on the first strip 6. Then, a second strap 1 is laid over the second strip 6 of tar or felt paper and secured or fastened to the base 5, in an area close to its leading edge and within the overlap portion B, in a manner similar to that described with respect to the securing or fastening of the first strip 6. The process of laying down each succeeding strip 6 of tar or felt paper is repeated in a manner similar to the laying down of the second strip 6 up to the rear side C of the base 5. In FIG. 2B, a strap 1 is shown near the leading edge of each strip 6 except for the first strip 6. The fastening or securing means in each strip 1 are not shown for the sake of clarity. FIG. 2B also shows a completed side of a roofing structure. When there is an opposite side of a roofing structure, as is often the case, the same procedure as was described with respect to FIG. 2A and FIG. 2B is also used to lay down strips 6 of tar or felt paper on the opposite or image side of the roofing structure (not shown). It will be appreciated that the process of laying down strips 6 of tar or felt paper on the base 5 of a roofing structure has been appreciably facilitated by using the multi-purpose strap 1 of this invention since a pneumatic hammer can be used to speedily tack down the strips 6 of tar or felt paper to said base 5, thereby resulting in a substantial saving of construction time for the roofer. It will also be appreciated that the holding down or fastening of the strips of tar or felt paper in the overlap areas by the multi-purpose strap of this invention insures the prevention of wind blow-off or up-lift of the strips before the shingles are laid down.

Figure 3:
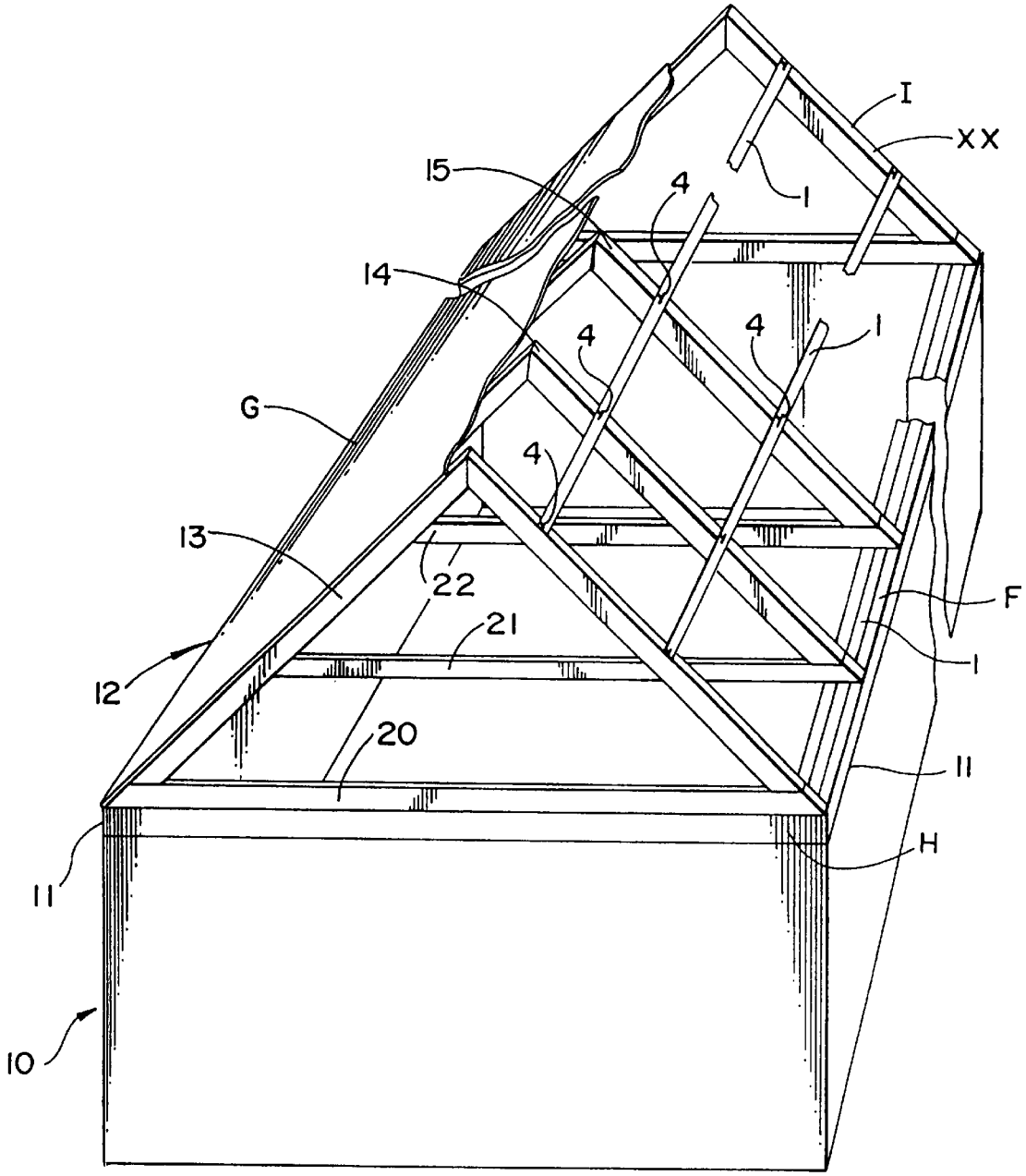
FIG. 3 is a broken away, perspective view of a building structure with a roofing truss arrangement utilizing the multi-purpose strap of this invention.

Reference is now made to FIG. 3 wherein there is shown a building 10 with a roofing structure 12 supported on a base frame 11. A plurality of roofing trusses 13, 14, 15, . . . XX are shown mounted on the base frame 11. The mounting of these roofing trusses onto the base frame 11 is done in the following manner. A multi-purpose strap 1, such as shown in FIG. 1, is secured to each long side F,G of the mounting frame 11 (only one side of which is shown in FIG. 3 for the sake of simplicity). Each of these multipurpose straps 1 has periodically spaced marks 4 such as shown in FIG. 1 which marks are successively spaced, for example, 24 inches or 2 feet apart (from centerline to centerline), to position each truss along the long sides F and G of the base frame 11 (marks 2 and 3 are not shown in FIG. 3 for the sake of simplicity). Again, for the sake of simplicity, one strap 1 is shown only at side F of the base frame. The strap 1 is secured to the base frame 11 (for example, with nails at opposite ends thereof) and has a first mark 4 on the strap 1 positioned at the front side H of the base frame 11. A front or foremost truss 13 is plumbed and secured onto the base frame 11 at the first mark 4 on the strap 1 on both sides F and G of the base frame 11. A back or rearmost truss XX is plumbed and secured to the rear side 1 of the base frame 11 in an opposing position relative to the front or foremost truss 13. Then, at least one multi-purpose strap 1 is tacked or secured at each end thereof to each of the secured opposing trusses 13 and XX on one side of the roofing structure and at a location or locations between the apices and bases of said opposing trusses. In FIG. 3, two straps 1 are shown for purposes of illustration. A first mark 4 on the at least one strap 1 is aligned with the front side H of the base frame 11. Then, the succeeding truss 14 is spaced from the front or foremost truss 13 utilizing the next or succeeding mark 4 on the strap 1 and secured to the base frame 11. The at least one strap 1, which was previously secured to the opposing trusses 13, XX, is now secured or nailed to the succeeding truss 14 at a second or succeeding mark 4 on said at least one strap by means of a pneumatic hammer; this process is repeated for each succeeding truss 15, . . . The preceding processes are also repeated for the other or image side G of the roofing structure. As the trusses 13, 14, 15, . . . , XX are now properly spaced from each other and secured to the base frame 11 as well as being fastened in spaced relationship to each other by means of at least one strap 1 located between their apices and bases, roofing sheaths (for example, sheaths of plywood of a predetermined thickness) can now be secured to the rafters of the aforementioned trusses. An alternative procedure would be to a line and secure successive trusses, between the front and back trusses 13, XX, to the base frame 11 utilizing the multi-purpose straps 1 on each side F,G of the base frame 11. Fastening at least one multi-purpose strap to the front and back trusses 13, XX, respectively, on one side of the roofing structure in a manner previously explained. Then, aligning each successive truss with the appropriate mark 4 on the at least one multi-purpose strap and fastening the at least one multi-purpose strap to each successive truss at the appropriate mark 4 in a manner previously explained. This procedure is then repeated for the other side of the roofing structure.

The straps 1 remain an integral and permanent part of the roofing structure. It will be appreciated that the process of erecting a roofing structure utilizing the multi-purpose strap 1 of this invention results in an appreciable reduction of construction time for the roofer since the cumbersome use of the conventional wooden cross-members on the rafters of roofing trusses has been eliminated as well as the conventional use of measuring sticks or tapes with numerical indicia thereon. Furthermore, there is a substantial reduction in costs since the conventional wooden cross-members are not used.

Figure 4:
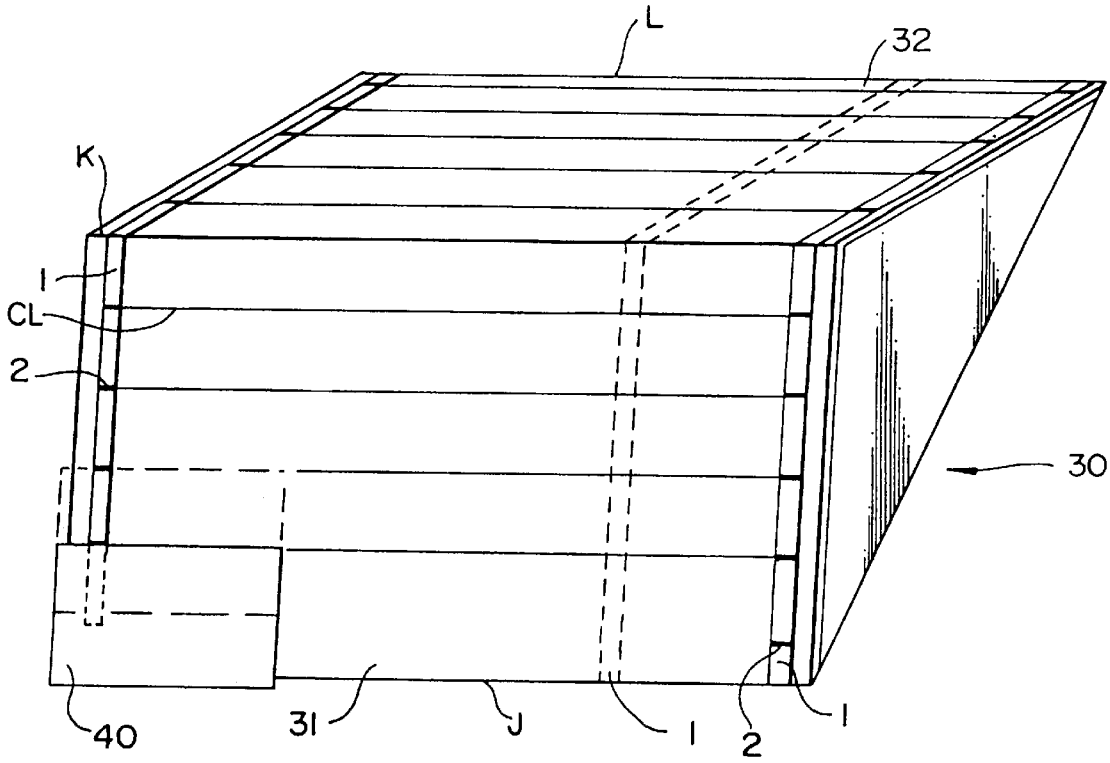
FIG. 4 is a perspective view of another roofing structure utilizing the multi-purpose strap of this invention.

Referring now to FIG. 4, there is shown a roofing structure 30 of the gable-type for purposes of illustration in the use of the multi-purpose strap 1 of this invention for laying down shingles on a base of said structure. In this application, the tar or felt paper has already been laid down on the base 31 of the roofing structure 30 but is not shown in FIG. 4 for the sake of simplicity. A first multi-purpose strap 1 of this invention is positioned near the left side edge of base 31 and a first mark 2 on strap 1 is positioned at a predetermined distance from the gutter edge J of base 31 such that, when the lagging edge of a first shingle 40 is aligned with the first mark 2, the first shingle will overhang the gutter edge J by a small amount (usually, about 1 inch), such as shown in FIG. 4. The first strap 1 is then secured or fastened at this first location and pulled or stretched over base 31, apex K of the roofing structure 30, towards the gutter edge L of base 32. [For the sake of simplicity, the other marks 3 and 4 are not shown on strap 1 in FIG. 4. Alternatively, strap 1 may be of the embodiment wherein marks 2 appear on one side of the strap 1 and marks 3 and 4 appear on the opposite or obverse side of the strap 1.] In any case, strap 1 is then secured or fastened to the base 32 at a mark 2 which will allow a shingle, similar to the first shingle 40, to overhang the gutter edge L of base 32 by an amount similar to that for the first shingle 40. Any slack in the first strap 1, as a possible consequence of this alignment of the first strap 1 with respect to the gutter edge L, is taken up near the apex K of the roofing structure 30 and the strap 1 is then secured or fastened to the base 32 near the apex K. The first strap 1 may also be secured or fastened to the bases 31 and 32 at other locations between the strap's ends, if necessary. A second multi-purpose strap 1 is then positioned near the right side edge of base 31 and spaced from the gutter edge J of base 31 at a mark 2 which is at the same distance from edge J as the first mark 2 on the first multi-purpose strap 1. The second multi-purpose strap 1 is secured or fastened at this location and pulled or stretched over base 31, apex K of the roofing structure 30, towards the gutter edge L of base 32 and secured or fastened to base 32 in a manner similar to that described with reference to the first multi-purpose strap 1. Then, parallely spaced chalk lines CL are struck on the tar or felt paper on both bases 31,32 of the roofing structure 30 which lines are used to a line all the shingles for the roofing structure. A first shingle 40 is aligned with a first chalk line CL (nearest the gutter edge J) at one corner of the roofing structure 30 wherein said alignment provides for an overhang of the gutter edge J of the base 31 such as shown in FIG. 4. The first shingle 40 is secured or fastened to the base 31 by utilizing, for example, shingle nails and a pneumatic hammer. A second or succeeding shingle 40 (shown in dashed outline in FIG. 4) is then aligned, at its lagging edge, with the second or succeeding chalk line CL on the base 31. This alignment provides for a 5 inch overlap of the second shingle with respect to the first shingle 40. This overlap is conventional in the roofing art, although strap 1 may be marked at spaced intervals to provide for other overlap distances, as desired. The second or succeeding shingle 40 is then secured or fastened to the base 31, as was done with the first shingle 40, by utilizing, for example, shingle nails and a pneumatic hammer. This process is repeated for each successive shingle 40 up to the apex K of the roofing structure 30, thus providing a column of shingles 40. A process similar to that of laying down a column of shingles 40 on the base 31 is also repeated for the remainder of base 31 and for the other side, i.e. base 32, of the roofing structure 30 starting at the gutter edge L of the base 32. Alternatively, the first multi-purpose strap 1 may be positioned and secured near the right hand side of the base 31 and the second multi-purpose strap 1 may be positioned and secured near the left hand side of the base 31. Clearly, the first shingle 40 may be laid down starting from either the right hand corner or the left hand corner of the base of the roofing structure 30. Furthermore, there may be folded or bent shingles at the apex K of the roofing structure 30. Therefore, the process for laying down the first column of shingles 40 will be repeated for each column of shingles 40 necessary to cover the whole roofing structure 30. It is also contemplated that the shingles may be laid down and secured to the bases 31, 32 of the roofing structure 30 in rows rather than columns.

Alternatively, instead of striking chalk lines on the bases 31,32, additional multi-purpose straps 1 may be positioned and secured between the first and second multi-purpose straps 1 (only one of such straps 1 is shown in dashed lines in FIG. 4). The number of additional multi-purpose straps used will depend on the length of the roofing structure 30, as would be obvious to the roofer. Then, these additional multi-purpose straps 1 together with the first and second straps 1 will serve as the alignment means for laying down the shingles 40 for the roofing structure 30.

As a result of either of the preceding processes, the multi-purpose straps 1 used in the laying down of shingles 40 become an integral and permanent part of the roofing structure 30. As in the other construction procedures, a pneumatic hammer can be used to secure or fasten the multi-purpose straps 1, as well as the shingles 40, to the bases 31,32 of the roofing structure 30. It will be appreciated that by utilizing the multi-purpose straps 1 of this invention, the laying down of shingles on a roofing structure has been facilitated resulting in an appreciable reduction in construction time for the roofer.

Figure 5:
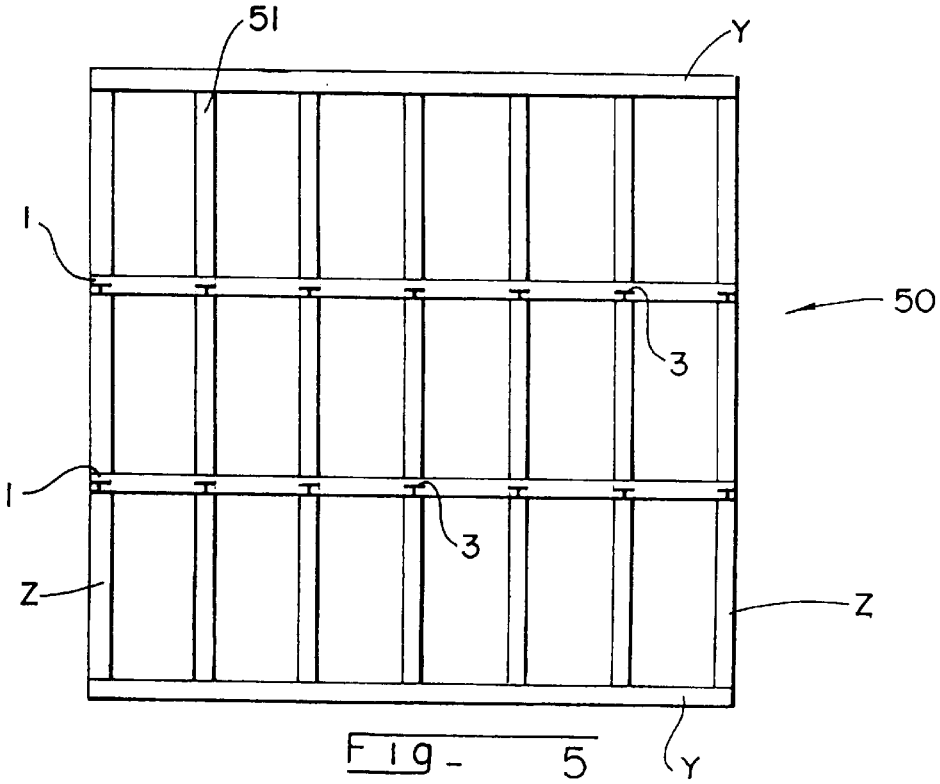
FIG. 5 is a top plan view of a floor structure utilizing the multi-purpose strap of this invention.

Referring now to FIG. 5, there is shown the framework 50 for a floor structure. The framework generally comprises a peripheral, support frame defined by elongated, wooden members Y, Z,Y, Z having secured therein a plurality of elongated, parallely spaced, wooden members or joists 51, conventionally 2×12 inches in size. It is generally the practice, as was previously explained, to space and temporarily maintain the spacing between successive joists 51 by securing elongated, wooden members, usually, 2×4's. These wooden members would be systematically removed in sections as each floor sheath, conventionally of plywood, is secured or fastened to the framework. However, in lieu of the 2×4's, a plurality of the multi-purpose straps 1 of this invention is used. As shown in FIG. 5, at least one strap 1 is secured or fastened at one of its ends to one of the frame members Z; this securement is made at a mark 3 on the strap 1. The other end of the strap 1 is secured or fastened to the opposite frame member Z, this securement may or may not occur at one of the marks 3 on the strap. Subsequently, each successive mark 3 on the strap 1 is used to a line or space each successive joist 51 in the framework 50, the spacing between successive marks 3 being, for example, 16 inches (from centerline to centerline) which is conventional for spacings between floor joists. One or more of the straps 1 of this invention may be used in this floor construction depending on the overall size of the floor. For purposes of illustration only, two straps 1 are shown in FIG. 5. As in the previous construction applications explained hereinbefore, a pneumatic hammer may be used to drive securing or fastening means, for example, nails or staples, into the strap 1 and joist 51. After the at least one multi-purpose strap 1 has been secured or fastened to the joists 51 of the framework 50, sheaths of plywood can immediately be laid down over the framework 50 and fastened or secured thereto. Also, as in the other applications, the strap or straps 1 used in this construction application become an integral and permanent part of the floor structure. It will be appreciated that by using the multi-purpose strap 1 of this invention, the construction of a wooden floor has been facilitated resulting in a substantial reduction in construction time for the carpenter.

Although not specifically elaborated on, the strap 1 of this invention can be used to initially a line or space the joists 51 in the framework 50 by tacking a strap 1 to each of the members Y,Y and using marks 3 thereon to a line and space the joists 51 at the respective ends thereof This process can also be applied to aligning and spacing studs in a wall structure.

Although the specific roof embodiments disclosed herein have been directed to gable-type roofs, it would be obvious to those skilled in the roofing art that the methods disclosed herein can readily be adapted to other types of roofs, for examples, shed roofs, gambrel roofs, mansard roofs, etc.

While the invention has been particularly shown and described with reference to preferred embodiments thereof, it will be understood by those skilled in the art that various changes and modifications in form and detail may be made therein without departing from the spirit and scope of the invention.

What is claimed is:

1. A non-alphanumeric, multi-purpose, positioning and fastening strap for use in the construction of a building, said strap comprising an elongated, flexible, durable and non-stretchable strap, said strap being substantially flat and having one major side and an opposite major side, said one major side having, at least two sets of spaced, periodic marks thereon and positioned along the longitudinal length of said strap wherein one set of marks is located along, one longitudinal edge of said strap and is perpendicular to and abuts said longitudinal edge and wherein another set of marks is located along an opposite longitudinal edge of said strap and is perpendicular to and abuts said opposite longitudinal edge and said periodic marks of said another set being at spaced intervals different from the spaced intervals of said periodic marks of said one set.

2. The multi-purpose strap as recited in claim 1, wherein said one set of marks and said another set of marks are color coded, said one set being of one color and said another set being of a different color.

3. The multi-purpose strap as recited in claim 1, wherein said strap further comprises a third set of spaced, periodic marks thereon, said third set of marks being located on said one major side of said strap as said at least two sets of spaced, periodic marks, each of said third set of marks being a substantially straight line extending perpendicularly from said one longitudinal edge to said opposite longitudinal edge, and said periodic marks of said third set being at spaced intervals different from said periodic marks of said one set and from said periodic marks of said another set.

4. The multi-purpose strap as recited in claim 3, wherein said one set, said another set, and said third set of marks are color coded, said one set being of one color, said another set being of another color, and said third set being of a third color.

5. The multi-purpose strap as recited in claim 1, wherein said strap further comprises a third set of spaced, periodic marks thereon, said third set of marks being located on said opposite major side of said strap, each of said third set of marks being a substantially straight line extending perpendicularly from said one longitudinal edge to said opposite longitudinal edge, and said periodic marks of said third set being at spaced intervals different from said periodic marks of said one set and said periodic marks of said another set.

6. The multi-purpose strap as recited in claim 5, wherein said one set, said another set, and said third set of marks are color coded, said one set being of one color, said another set being of another color, and said third set being of a third color.

7. The multi-purpose strap as recited in claim 1, wherein said strap is made from a hard plastic.

8. The multi-purpose strap as recited in claim 1, wherein said strap has a high breaking load.

9. The multi-purpose strap as recited in claim 8, wherein said breaking load is greater than 200 lbs.

10. The multi-purpose strap as recited in claim 8, wherein said breaking load is greater than 500 lbs.

11. The multi-purpose strap as recited in claim 1, wherein said strap is a polystrap.

12. The multi-purpose strap as recited in claim 11, wherein said polystrap is made from polypropylene.

13. The multi-purpose strap as recited in claim 1, wherein said one set of periodic marks and said another set of periodic marks are straight lines.

14. The multi-purpose strap as recited in claim 13, wherein said one set of periodic marks and said another set of periodic marks do not overlap one another.

15. The multi-purpose strap as recited in claim 1, wherein said one set of periodic marks and said another set of periodic marks do not overlap one another.

16. The multi-purpose strap as recited in claim 11 wherein said polystrap is made from polyester.

17. The multi-purpose strap as recited in claim 1 wherein said building has repetitively spaced construction elements and said one set of marks has any two consecutive marks spaced a fixed distance from each other and indicative of the spacing between repetitive construction elements of said building and wherein said another set of marks has any two consecutive marks spaced a fixed distance from each other, different from said marks of said one set, and indicative of the spacing between other repetitive construction elements of said building.

18. The multi-purpose strap as recited in claim 17 wherein said fixed distance between said two consecutive marks of said one set is sixteen inches and wherein said fixed distance between said two consecutive marks of said another set is two feet.

19. The multi-purpose strap as recited in claim 1 wherein said strap has no conventional indicia lines thereon for indicating fractions of an inch and no indicia lines thereon for a conventional millimeter scale.

* * * * *